US008251032B2

(12) United States Patent
Manther

(10) Patent No.: US 8,251,032 B2
(45) Date of Patent: Aug. 28, 2012

(54) SWITHCHABLE FINGER LEVER FOR A VALVE TRAIN OF AN INTERNAL COMBUSTION ENGINE

(75) Inventor: Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 291 days.

(21) Appl. No.: 12/802,115

(22) Filed: May 28, 2010

(65) Prior Publication Data

US 2010/0300390 A1 Dec. 2, 2010

Related U.S. Application Data

(60) Provisional application No. 61/217,541, filed on Jun. 1, 2009.

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 7,377,247 B2 * 5/2008 Seitz ..... 123/90.39

* cited by examiner

*Primary Examiner* — Ching Chang
(74) *Attorney, Agent, or Firm* — Volpe and Koenig, P.C.

(57) ABSTRACT

A switchable finger lever for a valve train of an internal combustion engine, said finger lever comprising an inner lever comprising on an underside on one end, a support for a gas exchange valve and on another end, a contact surface for a head of a support element, said inner lever further comprising on the one end, axle stubs protruding on two sides of the inner lever, a first outer arm extending for pivoting relative to the inner lever on one of the axle stubs and a second outer arm extending for pivoting relative to the inner lever on another one of the axle stubs, said outer arms extending in direction of the another end while flanking outer walls of the inner lever and being made as separate parts from each other, a cam contacting surface being arranged on an upper side of each outer arm while, in the region of the another end, a coupling device for an optional connection of the outer arms to the inner lever is seated in the inner lever, and a restoring spring means for each outer arm acts at one end against the inner lever and at another end against the respective outer arm.

15 Claims, 2 Drawing Sheets

SWITHCHABLE FINGER LEVER FOR A VALVE TRAIN OF AN INTERNAL COMBUSTION ENGINE

The present application claims the benefit of U.S. provisional application Ser. No. 61/217,541 filed Jun. 1, 2009.

FIELD OF THE INVENTION

The invention concerns a switchable finger lever for a valve train of an internal combustion engine, said finger lever comprising an inner lever comprising on an underside on one end, a support for a gas exchange valve and on another end, a contact surface for a head of a support element, a coupling device for an optional connection of outer arms to the inner lever being seated in the inner lever on said another end, and said outer arms serving as a contacting surface for lift cams and for restoring spring means.

BACKGROUND OF THE INVENTION

Known prior art switchable finger levers have a too solid construction and are too large while being too complicated for mass production and too complex to assemble and possess an excessively high mass moment of inertia (s. DE 10 2006 046 573 A1) due to the arrangement of important components such as the restoring spring means on their valve side.

OBJECT OF THE INVENTION

It is therefore an object of the invention to provide a switchable finger lever of the pre-cited type in which the aforesaid drawbacks are eliminated.

SUMMARY OF THE INVENTION

The invention achieves the above object by the fact that the inner lever of the switchable finger lever comprises on the one end, axle stubs protruding on two sides of the inner lever, a first outer arm extending for pivoting relative to the inner lever on one of the axle stubs and a second outer arm extending for pivoting relative to the inner lever on another one of the axle stubs, said outer arms being made as separate parts from each other while, in a region of the another end, a coupling device for the optional connection of the outer arms to the inner lever is seated in the inner lever, and the restoring spring means for each of the free outer arms acts at one end against the inner lever and at another end against a respective one of the outer arms.

In this way, a switchable finger lever is provided in which the aforesaid drawbacks are eliminated. The finger lever has a compact structure, is easy to mount and possesses only a small mass as also a low mass moment of inertia.

The restoring spring means is preferably configured as two torsion leg springs mounted on the another end of the finger lever directly next to the contact surface for the head of the support element. The outer arms which are physically separated from each other can be relatively simply mounted on their axle stubs which protrude from the inner lever. Mounting is effected for instance through an interference fit but the outer arms can also be seated alternatively "loosely" on the axle stubs and secured against loss through a simple-to-realize calking or the like.

According to a further proposition of the invention, the axle stubs can be configured as a part of a continuous axle on the one end of the inner lever. In this way, only one cross-bore must be provided for the axle in this region of the inner lever.

As complementary surface for the support element on the another end of the inner lever, the invention proposes, for example, a semi-spherical cavity. Conceivable and intended is, however, also the arrangement of a swivel joint in this region. Hydraulic medium for switching coupling pistons of the coupling device is preferably supplied through a head of the support element and the semi-spherical cavity in the inner lever.

For mounting the two torsion leg springs as restoring spring means on the another end of the finger lever, the invention proposes to let appropriate axle stubs, which obviously can also be component parts of a continuous axle, protrude from a respective outer wall of the inner lever. The coil assemblies of the torsion leg springs are mounted on these axle stubs, a first and a second leg extending away from each coil assembly, said first leg being biased against a stop of the inner lever and said second leg being biased against a support of the underside of the respective outer arm. The aforesaid restoring spring means is situated directly next to the fulcrum of the finger lever and thus has practically no negative effect on the mass moment of inertia of the finger lever. A particular advantage of this embodiment is that flanks of the second legs in mesh (contact region) with the support of the respective outer arm correspond at least partially to an involute toothing of gearwheel teeth in mesh with each other. This results in an extremely low-friction spring contact in the free swinging mode of the outer arms (uncoupling, low or zero valve lift).

For an improved guidance of the second leg of the restoring spring means, it is proposed to configure the outer arms with appropriate longitudinal recesses into which the second leg engages in the assembled state.

A particular additional advantage of the invention is that the torsion leg springs can first be mounted on their axle stubs, and the outer arms can then be pushed with their mounting eyes onto their axle stubs on the one end.

According to a further development of the invention, the outer arms should be given a substantially simple configuration in that they are constituted at least substantially by upright wall sections from whose upper sides preferably cylindrically arched cam contacting surfaces protrude in a direction leading away from a central longitudinal plane of the finger lever. Preferably, these cam contacting surfaces should be integrally connected to the wall sections and can be provided with deposited anti-wear coatings or the like.

Due to the proposed mirror image configuration of the two outer arms of the finger lever, it is possible to machine them, at least partially together, with a single tool. For this, it is proposed to chuck the outer arms of a lever (but also several pairs of arms) together and, for example, grind or finish together in some other way, at least their cam contacting surfaces.

The coupling device of the present, proposed finger lever is likewise seated in the region of the fulcrum and thus also has no significant influence on the mass moment of inertia of the finger lever. Proposed are, for example, two coupling pistons that can be displaced out of a cross-bore and which, for achieving coupling, (high valve lift), can be displaced partially under a complementary entraining surface on the free swinging end of the outer arms. As entraining surface, it is proposed to configure on each outer arm, a complementary cavity such as a semi-shell, a quarter-shell, a bore or the like, but also a flat. If the coupling pistons are flattened in their coupling regions, the entraining surface is likewise flattened. Thus, in the final analysis, the free swinging ends of the outer arms engage the coupling pistons after the manner of a stirrup.

According to a further advantageous proposition of the invention, the finger lever is configured as a lift alteration switch. In this case, the inner lever comprises a contacting surface such as a sliding surface or a roller for a low lift cam, whereas the cam contacting surfaces on the outer arms are intended for a contact of high lift cams and are likewise configured as rollers or sliding surfaces.

However, it is also proposed to configure the finger lever as a lift deactivator, in which case the inner lever does not comprise any contacting surface for a lift cam, or comprises a contacting surface only for a so-called zero lift cam.

According to another proposition of the invention, each outer wall of the inner lever comprises a projection serving as a stop for the respective first leg of the restoring spring means. The first leg can be biased against this stop. If necessary, a lateral projection or the like may also be arranged in this region, to that the leg is prevented from jumping-off.

The inner lever/the outer arms are manufactured by casting or made by punching and bending out of sheet steel.

The first legs of the torsion leg springs can be connected to each other behind the another end of the finger lever to form an assembled unit.

If necessary, for instance for reasons of rigidity, the outer arms can also be connected, for example, at their free swinging ends through a bow extending on the underside.

BRIEF DESCRIPTION OF THE DRAWING

The invention will now be described more closely with reference to the appended drawing in which the figures show.

DETAILED DESCRIPTION OF THE DRAWING

Figure 1:
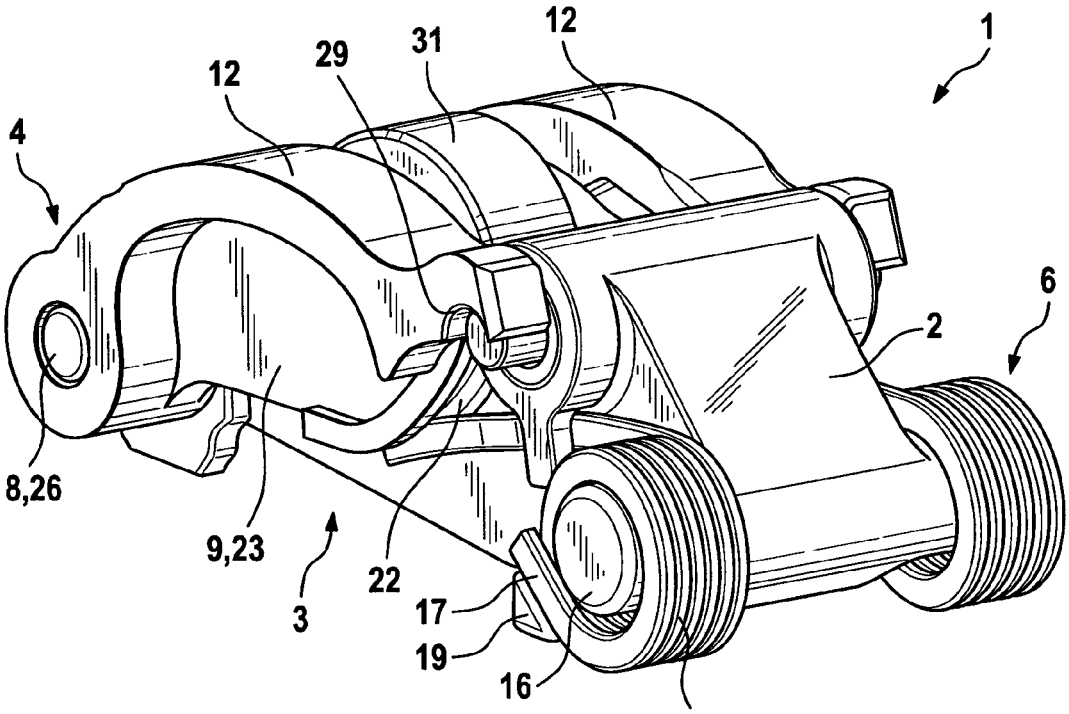
FIG. 1, a three-dimensional view of the finger lever seen from the another end.

The figures show a switchable finger lever 1 configured in the present case as a lift alteration switch. The finger lever 1 comprises an elongate inner lever 2 which comprises on an underside 3 at one end 4, a support 5 for a gas exchange valve. At another end 6 of the inner lever 2 is arranged a contact surface 7 configured in the present case as a semi-spherical cavity for receiving a head of a support element.

Figure 2:
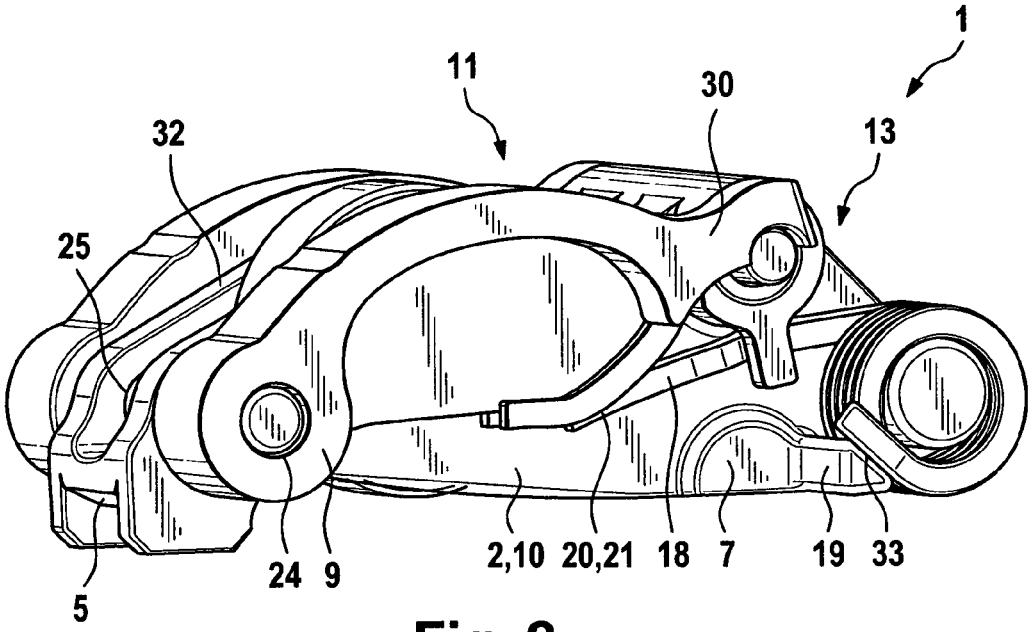
FIG. 2, a three-dimensional view of the finger lever of FIG. 1, but seen from the one end, and FIG. 3, a cross-section through the finger lever in the region of its uncoupling device.
Figure 3:
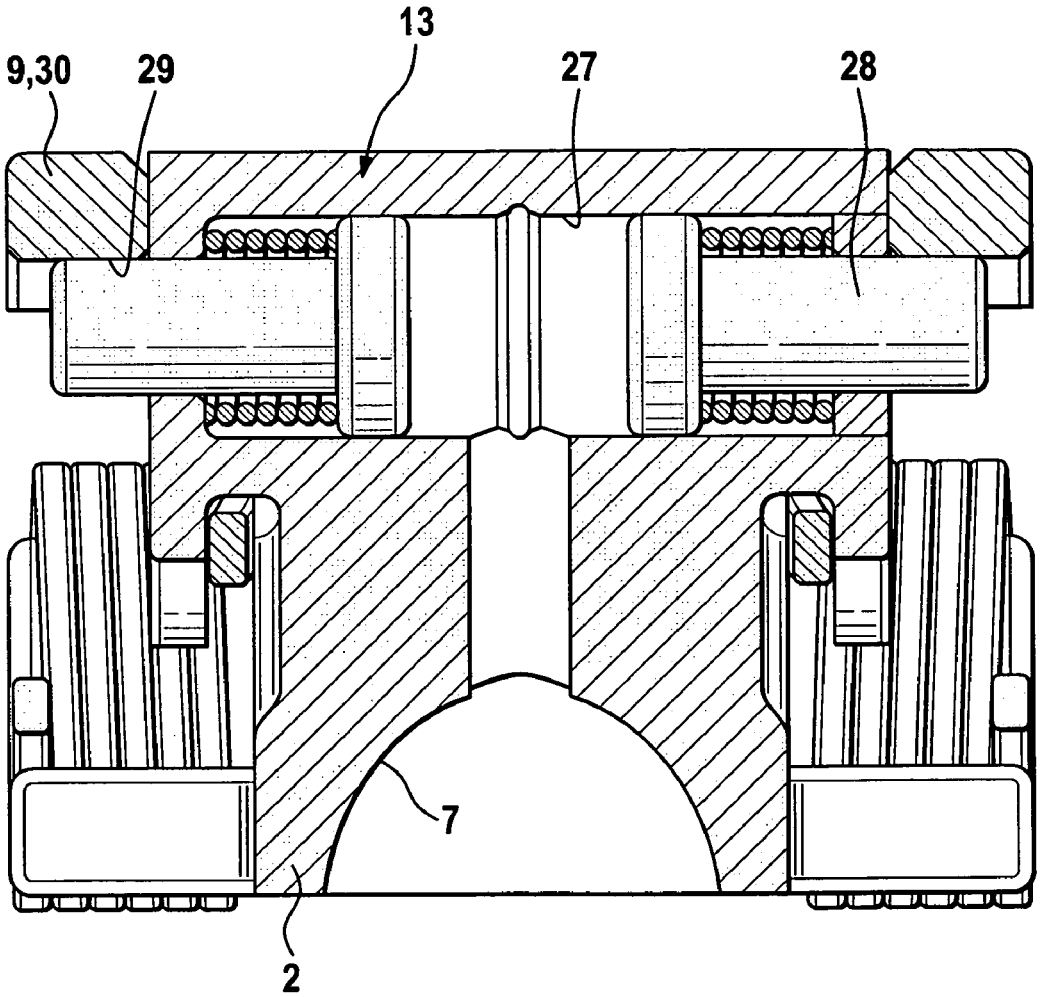

As can be seen in FIGS. 1, 2, the inner lever 2 comprises on the one end 4, an axle stub 8 projecting on each side. These axle stubs 8 are component parts of an axle 26 that extends through a bore 25 of the inner lever 2. An outer arm 9 is arranged for pivoting through its mounting eye 24 on each of the axle stubs 8.

Each outer arm 9 comprises an upright wall section 23 from whose upper side 11 protrudes a roof-shaped cam contacting surface 12. Each cam contacting surface 12 is cylindrically arched and merges in direction towards the another end 6 into a free swinging end 30. Each free swinging end 30 comprises on its underside 3, an entraining surface 29 configured as a semi-shell-shaped cavity.

A running surface 31 configured as a rotating roller is arranged in a recess 32 of the inner lever 2. The running surface 31 extends on a pin, not illustrated, preferably through a rolling bearing and serves for a contact of a low lift cam. In contrast, the cam contacting surfaces 12 of the outer arms 9 of the inner lever 2 mentioned in the previous paragraph serve for a contact of high lift cams.

A coupling device 13 extends in the region above the contact surface 7 of the inner lever 2. This coupling device 13 comprises a through-bore 27 in which are seated diametrically opposite each other, two coupling pistons 28. To effect coupling, each of the coupling pistons 28 engages under the entraining surface 29 on the free swinging end 30 of the outer arms 9, so that a high valve lift is enabled. The coupling pistons 30 can be displaced hydraulically in coupling direction and through compression spring force in uncoupling direction.

Directly in the region of the another end 6, an axle stub 16 projects from each of the outer walls 10 of the inner lever 2. A restoring spring 14 (torsion leg spring) is seated with its coil assembly 15 on each axle stub 16. If appropriate, the coil assembly 15 can also be mounted on the respective axle stub through a bushing.

A first and a second leg 17, 18 extends away from each coil assembly 15. The first leg 17 acts on an upper side 33 of a stop 19 which is configured as a projection and protrudes integrally from the outer wall 10. The second leg 18 acts against a support 20 of the underside 3 of the respective outer arm 9. Flanks of the second legs 18 in mesh with the support 20 correspond at least partially to an involute toothing of gearwheel teeth in mesh with each other. Thus, in the case of uncoupling of the outer arms 9 from the inner lever 2 (low valve lift) and a consequently required cam resetting of the outer arms 9 through the second legs 18, an extremely low-friction contact region is created.

As best seen in FIG. 1, each outer arm 9 comprises on the underside 3 in the region of the support 20, a longitudinal recess 22. In this longitudinal recess 22 is seated the second leg 18 of the restoring spring means 14 which thus has an excellent lateral guidance. Further, a spring leg retainer 34 projects downwards from the coupling element exit on the outer wall 10 of the inner lever 2, and the second leg 18 is guided in this spring leg retainer 34. This retainer 34 can also be configured alone, i.e. without the longitudinal recess 22 which, in its turn, can likewise be configured alone without the retainer 34.

The outer arms 9 are configured as mirror images of each other, so that at least their cam contacting surfaces 12 can be machined in pairs.

The invention claimed is:

1. A switchable finger lever for a valve train of an internal combustion engine, said finger lever comprising an inner lever comprising an underside on one end, a support for a gas exchange valve and on another end, a contact surface for a head of a support element, said inner lever further comprising on the one end, axle stubs protruding on two sides of the inner lever, a first outer arm extending for pivoting relative to the inner lever on one of the axle stubs and a second outer arm extending for pivoting relative to the inner lever on another one of the axle stubs, said outer arms extending in direction of the another end while flanking outer walls of the inner lever and being made as separate parts from each other, a cam contacting surface being arranged on an upper side of each outer arm while, in the region of the another end, a coupling device for an optional connection of the outer arms to the inner lever is seated in the inner lever, and a restoring spring means for each outer arm acts at one end against the inner lever and at another end against the respective outer arms.

2. The switchable finger lever of claim 1, wherein the restoring spring means is configured as two torsion leg springs, a coil assembly of each torsion leg spring being seated on an axle stub which protrudes from a respective one of the outer walls of the inner lever in a region of the another end, a first and a second legs extending away from each of the coil assemblies, said first leg being clamped against a stop of the inner lever and said second leg being clamped against a support of the underside of a respective one of the outer arms.

3. The switchable finger lever of claim 2, wherein flanks of the second legs in mesh with the support of the respective outer arm correspond at least partially to an involute toothing of gear teeth in mesh with each other.

4. The switchable finger lever of claim 2, wherein, in a region of the support, the outer arm comprises a longitudinal recess or projections for a lateral guidance of the adjoining second leg of the restoring spring means.

5. The switchable finger lever of claim 2, wherein the stop of the inner lever is configured as a projection extending integrally from a respective outer wall of the inner lever, and a respective first leg of the restoring spring means is clamped on an upper side of said projection.

6. The switchable finger lever of claim 1, wherein each outer arm comprises an at least substantially upright wall section from whose upper side the cam contacting surface protrudes, cylindrically arched, in a direction leading away from a central longitudinal plane of the finger lever, which cam contacting surface thickens in direction of the one end and forms a mounting eye through which the outer arm is seated on the axle stub.

7. The switchable finger lever of claim 1, wherein the axle stubs of the inner lever on the one end with the support are end component parts of an axle that extends through a bore of the inner lever, and wherein the outer arms are fixed against rotation on the axle stubs.

8. The switchable finger lever of claim 1, wherein the axle stubs of the inner lever on the one end are component parts of an axle that extends through a bore of the inner lever, and wherein the outer arms are mounted for rotation relative to the axle stubs and are secured against loss on the axle stubs through one of a snap ring, a spring clip connection or a calking.

9. The switchable finger lever of claim 1, wherein the coupling device comprises two coupling pistons that can be displaced out of a cross-bore of the inner lever in the region of the another end, which coupling pistons, to effect coupling, engage partially under or into a complementary entraining surface on a free swinging end of the outer arms.

10. The switchable finger lever of claim 9, wherein the coupling pistons are cylindrical in shape at least in a coupling section, and wherein the entraining surface is a semi-shell-shaped cavity on the underside of each respective outer arm.

11. The switchable finger lever of claim 1, wherein the finger lever is configured as a lift alteration device whose inner lever comprises a contacting surface for a low lift cam and whose cam contacting surfaces on the outer arms are intended for a contact of a lift cam larger than the low lift cam.

12. The switchable finger lever of claim 11, wherein a roller forming the contacting surface for the low lift cam is seated in a recess of the inner lever.

13. The switchable finger lever of claim 1, wherein the contact surface of the inner lever for the support element is configured as one of a semi-spherical cavity or as a part of a swivel joint.

14. The switchable finger lever of claim 1, wherein the outer arms are mirror images of each other.

15. The switchable finger lever of claim 1, wherein at least the cam contacting surfaces of the outer arms are machined with at least the two outer arms of a finger lever being arranged next to each other as a pair.

* * * * *

UNITED STATES PATENT AND TRADEMARK OFFICE

CERTIFICATE OF CORRECTION

PATENT NO. : 8,251,032 B2
APPLICATION NO. : 12/802115
DATED : August 28, 2012
INVENTOR(S) : Debora Manther It is certified that error appears in the above-identified patent and that said Letters Patent is hereby corrected as shown below:

ON THE TITLE PAGE, ITEM [54] AND COL. 1

Delete "Swithchable" and insert therefor --Switchable--.

Signed and Sealed this
Twenty-third Day of October, 2012

David J. Kappos

David J. Kappos
*Director of the United States Patent and Trademark Office*